US006499462B1

(12) United States Patent
Pursifull

(10) Patent No.: US 6,499,462 B1
(45) Date of Patent: Dec. 31, 2002

(54) ELECTRONIC THROTTLE CONTROL ALGORITHM THAT DETERMINES WHETHER A THROTTLE IS PROPERLY RESPONDING TO THROTTLE COMMANDS

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/574,984

(22) Filed: May 19, 2000

(51) Int. Cl.[7] ..... F02D 11/10
(52) U.S. Cl. ..... 123/396; 123/397; 123/399
(58) Field of Search ..... 123/396, 361, 123/399, 397

(56) References Cited

U.S. PATENT DOCUMENTS 4,491,112 A * 1/1985 Kanegae et al. ..... 123/351
5,115,396 A 5/1992 Keegan
5,159,831 A 11/1992 Kitagawa et al.
5,204,816 A 4/1993 Wright et al.
5,255,653 A 10/1993 Ironside et al.
5,524,724 A * 6/1996 Nishigaki et al. ..... 123/361
5,775,293 A 7/1998 Kresse
5,809,966 A 9/1998 Streib
5,927,250 A * 7/1999 Nishida ..... 123/399
5,983,860 A 11/1999 Kitamura et al.
6,009,853 A * 1/2000 Fujikawa et al. ..... 123/397
6,085,724 A * 7/2000 Schmidt et al. ..... 123/361

* cited by examiner

*Primary Examiner*—Erick R. Solis
(74) *Attorney, Agent, or Firm*—Quarles & Brady LLP

(57) ABSTRACT

A system and method for determining when a position of a throttle is not adequately conforming to a command signal provided by a control module, such that a fault indication should be provided, is disclosed. The system includes a throttle assembly including the throttle, which is configured to generate a position signal indicative of the position of the throttle, and a processor that is coupled to the throttle assembly and is configured to receive the command signal and the position signal. The processor is further configured to determine a first limit that is functionally dependent upon the command signal, the first limit delimiting an acceptable range of throttle positions from a first unacceptable range of throttle positions, and to determine that the position of the throttle is not adequately conforming to the command signal when the position of the throttle as indicated by the position signal is in the first unacceptable range of throttle positions.

20 Claims, 9 Drawing Sheets

FIG. 3A
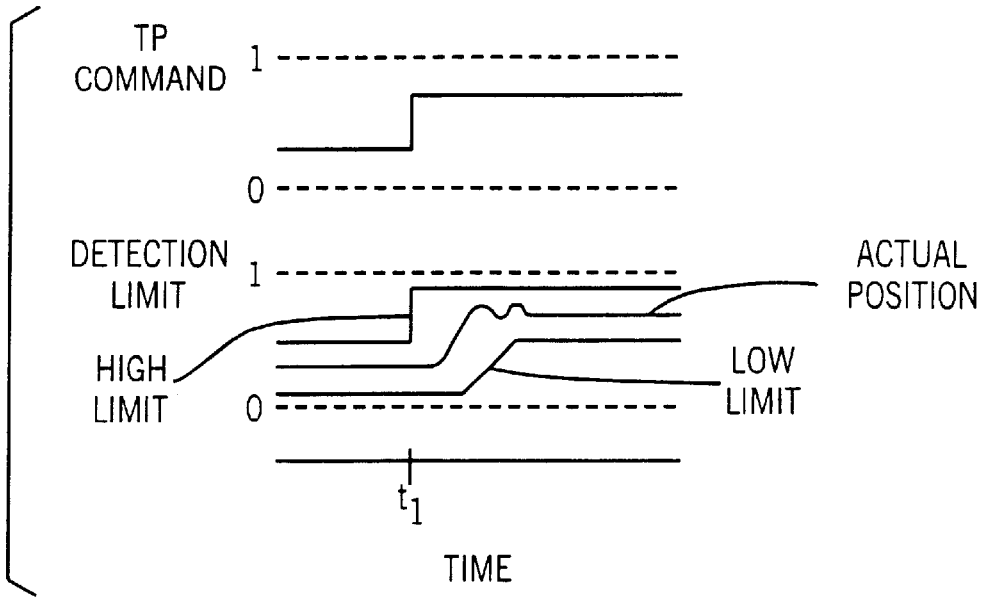
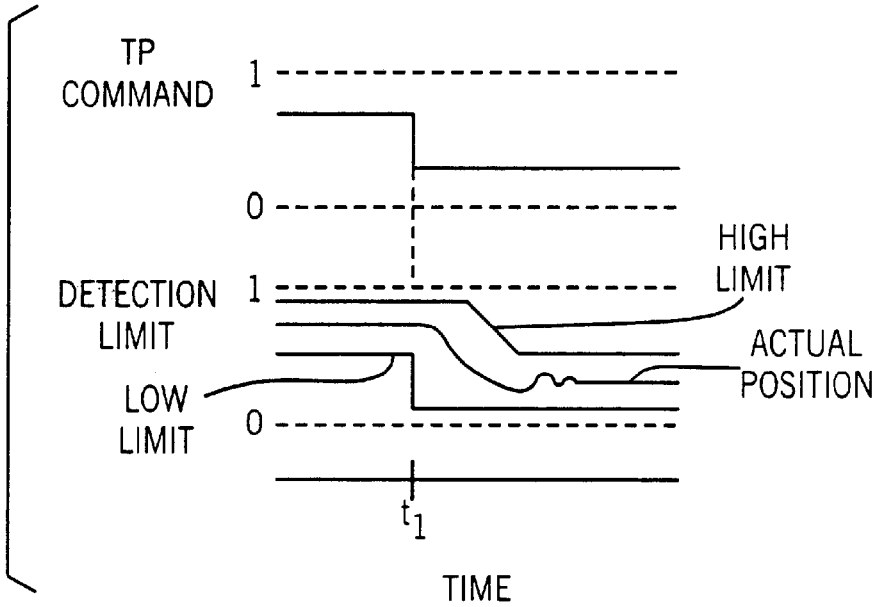
FIG. 3B

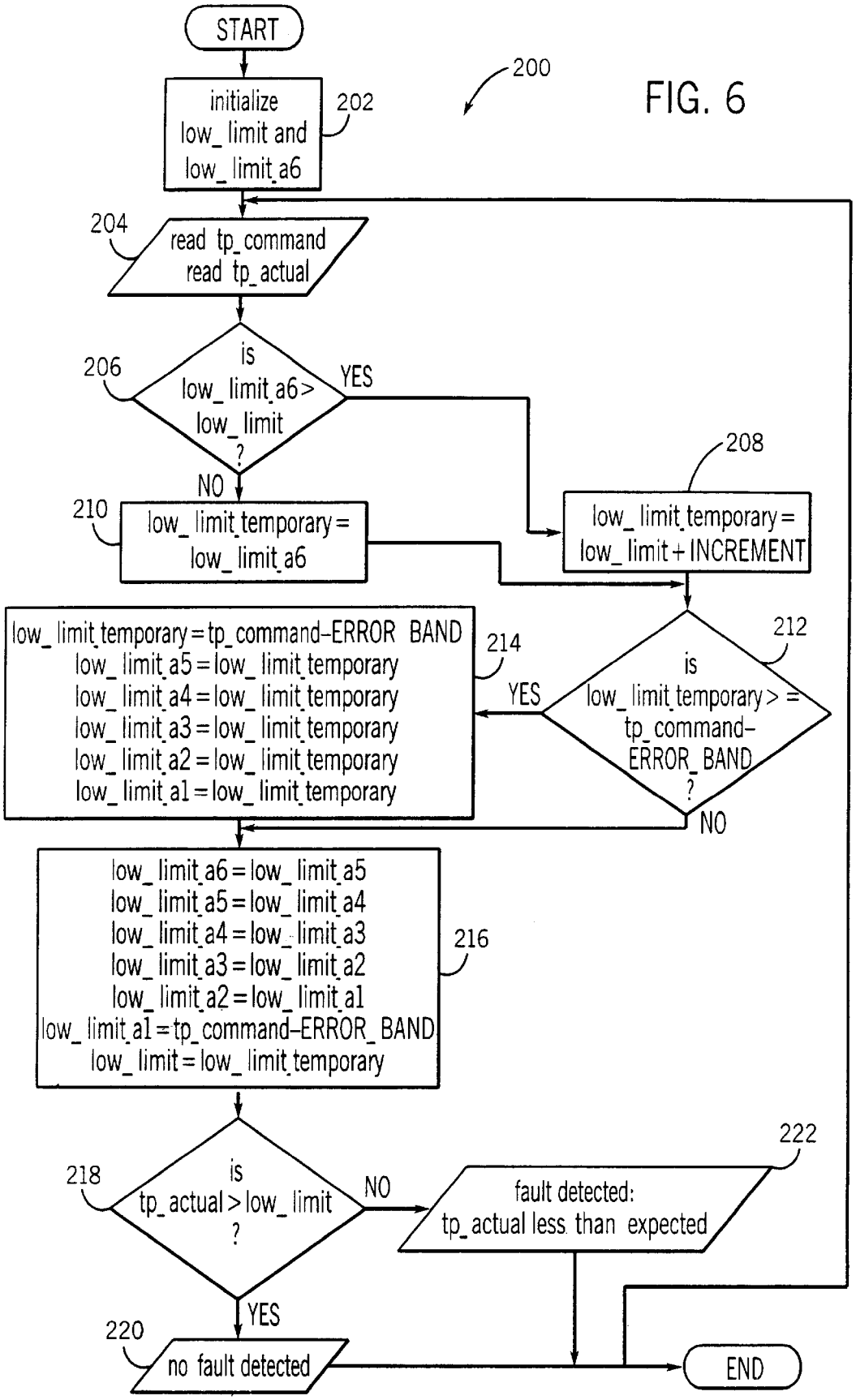
START
200
FIG. 6
initialize low_limit and low_limit_a6
202
204
read tp_command read tp_actual
206
is low_limit_a6 > low_limit ?
YES
NO
208
low_limit_temporary = low_limit + INCREMENT
210
low_limit_temporary = low_limit_a6
212
is low_limit_temporary > = tp_command-ERROR_BAND ?
YES
NO
214
low_limit_temporary = tp_command-ERROR BAND
low_limit_a5 = low_limit_temporary
low_limit_a4 = low_limit_temporary
low_limit_a3 = low_limit_temporary
low_limit_a2 = low_limit_temporary
low_limit_a1 = low_limit_temporary
216
low_limit_a6 = low_limit_a5
low_limit_a5 = low_limit_a4
low_limit_a4 = low_limit_a3
low_limit_a3 = low_limit_a2
low_limit_a2 = low_limit_a1
low_limit_a1 = tp_command-ERROR_BAND
low_limit = low_limit_temporary
218
is tp_actual > low_limit ?
NO
YES
222
fault detected: tp_actual less than expected
220
no fault detected
END

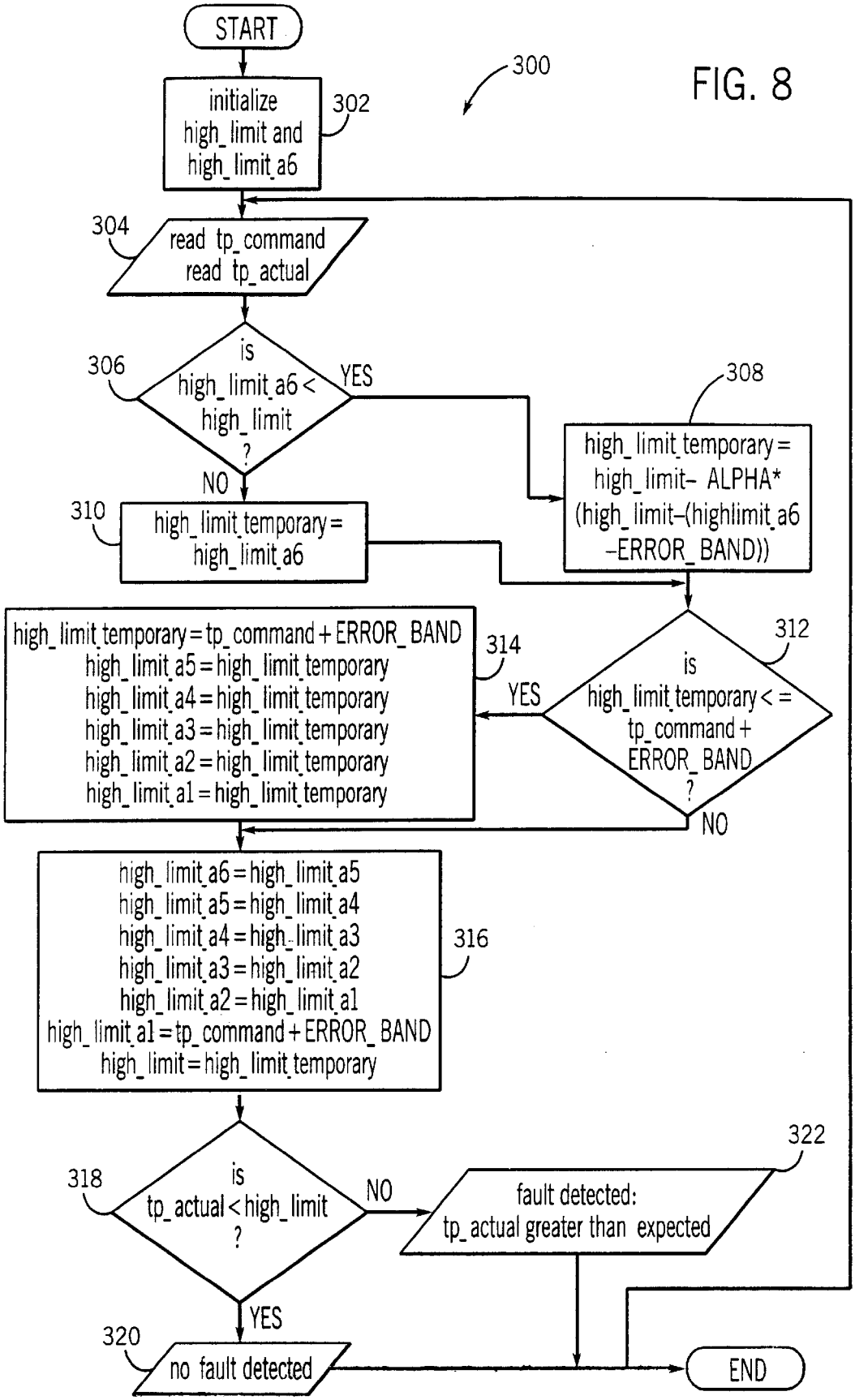
START
300
FIG. 8
initialize high_limit and high_limit_a6
302
304
read tp_command read tp_actual
306
is high_limit_a6 < high_limit ?
YES
NO
308
high_limit_temporary = high_limit- ALPHA* (high_limit-(highlimit_a6 -ERROR_BAND))
310
high_limit_temporary = high_limit_a6
312
is high_limit_temporary < = tp_command + ERROR_BAND ?
YES
NO
314
high_limit_temporary = tp_command + ERROR_BAND
high_limit_a5 = high_limit_temporary
high_limit_a4 = high_limit_temporary
high_limit_a3 = high_limit_temporary
high_limit_a2 = high_limit_temporary
high_limit_a1 = high_limit_temporary
316
high_limit_a6 = high_limit_a5
high_limit_a5 = high_limit_a4
high_limit_a4 = high_limit_a3
high_limit_a3 = high_limit_a2
high_limit_a2 = high_limit_a1
high_limit_a1 = tp_command + ERROR_BAND
high_limit = high_limit_temporary
318
is tp_actual < high_limit ?
NO
YES
322
fault detected: tp_actual greater than expected
320
no fault detected
END

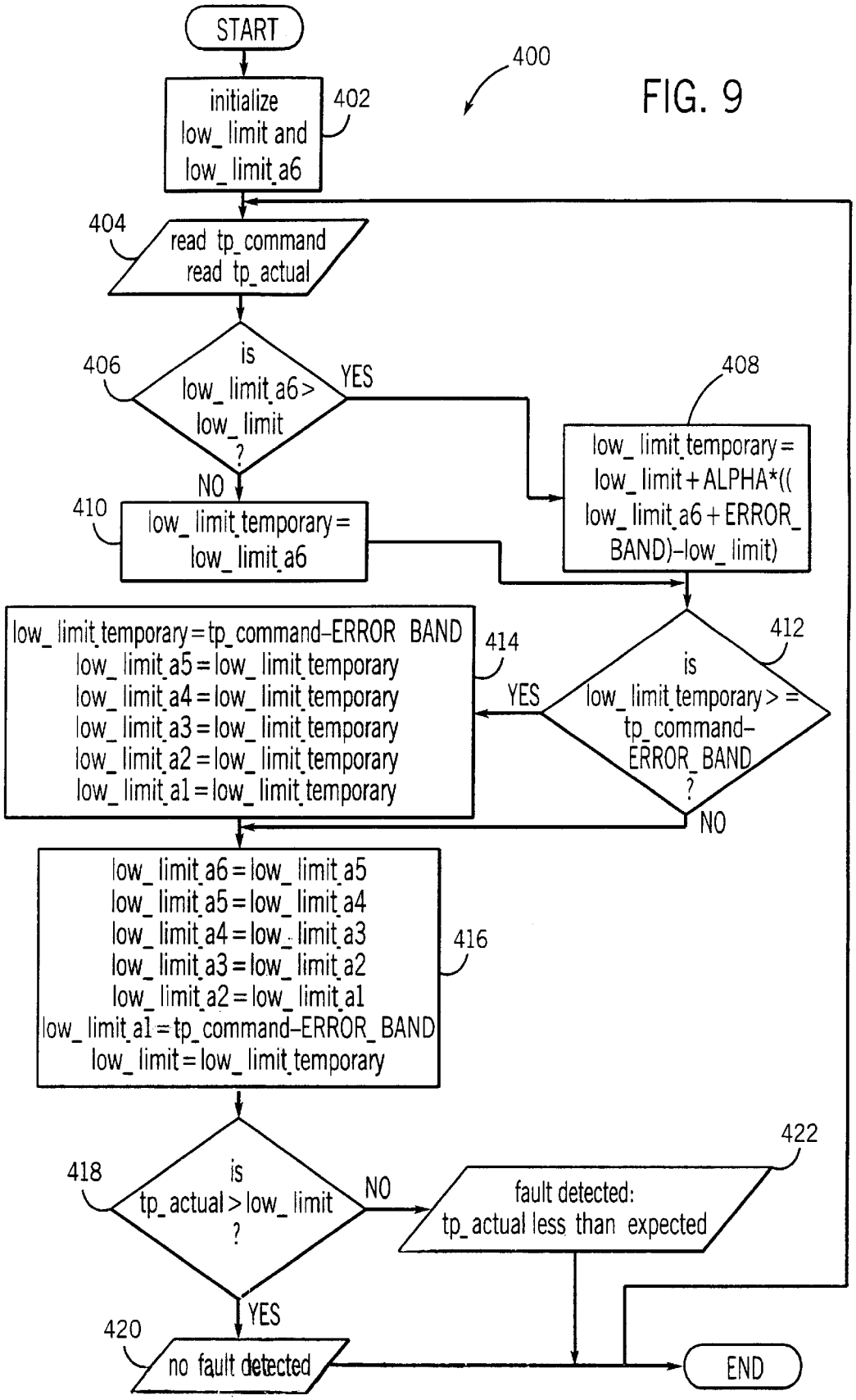
START
400
initialize low_limit and low_limit_a6
402
FIG. 9
404
read tp_command read tp_actual
406
is low_limit_a6 > low_limit ?
YES
NO
408
low_limit_temporary = low_limit + ALPHA*((low_limit_a6 + ERROR_BAND)-low_limit)
410
low_limit_temporary = low_limit_a6
412
is low_limit_temporary > = tp_command-ERROR_BAND ?
YES
NO
414
low_limit_temporary = tp_command-ERROR BAND
low_limit_a5 = low_limit_temporary
low_limit_a4 = low_limit_temporary
low_limit_a3 = low_limit_temporary
low_limit_a2 = low_limit_temporary
low_limit_a1 = low_limit_temporary
416
low_limit_a6 = low_limit_a5
low_limit_a5 = low_limit_a4
low_limit_a4 = low_limit_a3
low_limit_a3 = low_limit_a2
low_limit_a2 = low_limit_a1
low_limit_a1 = tp_command-ERROR_BAND
low_limit = low_limit_temporary
418
is tp_actual > low_limit ?
NO
YES
422
fault detected: tp_actual less than expected
420
no fault detected
END

ELECTRONIC THROTTLE CONTROL ALGORITHM THAT DETERMINES WHETHER A THROTTLE IS PROPERLY RESPONDING TO THROTTLE COMMANDS

FIELD OF THE INVENTION

The present invention relates to electronically controlled throttles for vehicle engines. In particular, the present invention relates to systems for detecting throttle failures.

BACKGROUND OF THE INVENTION

A throttle controls the flow of air, or air and fuel, inducted into an internal combustion engine, and thereby controls the power produced by the engine. Engine power defines the speed of the engine or vehicle to which it is attached, under a given load condition, and thus, reliable control of the throttle setting is important.

In prior art mechanical systems, a direct mechanical linkage controlled the throttle, typically in the form of a cable running from the accelerator pedal, operable by the user of the vehicle, to the throttle. Absent tension on the cable from the pedal, the throttle would revert to an idle opening (i.e., a default position) under the influence of a biasing spring. The idle opening provides sufficient inducted air and gas to permit low speed operation of the engine under no- or low-load conditions.

Although mechanical linkages are simple and intuitive, they are not readily adapted to electronic control of an engine such as may be desired in sophisticated emissions reduction systems or for features such as automatic vehicle speed control. For these purposes, the mechanical linkage may be replaced with electrical wiring carrying operator input signals from a position sensor associated with the accelerator pedal to a throttle controller, which in response sends throttle command signals to an electric motor (or other actuator) actuating the throttle. The operator input signals and throttle command signals may be monitored for loss or faults to provide greater reliability to the system.

While electronic control without mechanical linkages allows for a variety of desirable features, the removal of mechanical linkages eliminates the mechanical feedback such linkages provide. Throttle position is no longer physically tied to the operator's movement of the accelerator pedal. Because throttle operation is critical to vehicle operation, alternate mechanisms must be developed to determine whether a vehicle's throttle is operating in accordance with the throttle command signals derived from the operator input signals (and also in accordance with other commands provided by computer or other control elements within the vehicle).

Unfortunately, the design of such mechanisms is not simple. In the absence of dynamics, it would be possible to test whether a throttle was operating in accordance with throttle command signals simply by comparing the actual (i.e., measured) throttle position with the commanded throttle position. However, in practice, actual throttle position seldom equals commanded throttle position since there is usually (at least) some minimal error associated with the operation of the electric motor (in actuating the throttle), with the throttle position sensor or with some other element. In particular, the electric motor cannot respond instantaneously to changes in the throttle command signals. Actual throttle position often lags or overshoots changes in commanded throttle position. Therefore, a simple throttle monitoring mechanism that compares actual throttle position directly with commanded throttle position will too frequently find the throttle to be operating improperly.

Moreover, the acceptable, expected differences between actual throttle position and commanded throttle position are not within a constant error band, but rather dynamically change with the operation of the throttle. In particular, as the magnitude and frequency of changes in the throttle command signals increase, the difference between actual throttle position and commanded throttle position becomes even more pronounced. Therefore, a simple throttle monitoring mechanism that compares actual throttle position with the commanded throttle position plus (or minus) a constant error band also will too frequently find the throttle to be improperly operating even though the deviation between the actual throttle position and commanded throttle position is within an acceptable, expected range (unless the error band is made so large as to render the throttle monitoring mechanism overly tolerant).

Given the importance of determining whether a throttle is operating in accordance with throttle command signals, it would be advantageous to develop a throttle monitoring mechanism that accurately determined when the throttle was operating improperly. It would further be advantageous if such a mechanism was capable of determining improper throttle operation and yet at the same time was capable of ignoring expected deviations between actual throttle position and commanded throttle position due to acceptable levels of throttle lag, throttle overshoot and other error.

SUMMARY OF THE INVENTION

The present inventor has recognized that, for a throttle monitoring mechanism to both accurately determine improper throttle operation and be tolerant of expected deviations from ideal throttle performance, it would be desirable if the throttle monitoring mechanism was configured to allow for greater deviations between the actual and commanded throttle positions when such greater deviations were expected (i.e., when there were large and/or frequent changes in the throttle command signals), and to allow for only smaller deviations between the actual and commanded throttle positions when only such smaller deviations were expected.

The present invention therefore relates to a throttle error detection system for determining when a position of a throttle is not adequately conforming to a command signal provided by a control module such that a fault indication should be provided. The system includes a throttle assembly including the throttle, which is configured to generate a position signal indicative of the position of the throttle. The system further includes a processor that is coupled to the throttle assembly and is configured to receive the command signal and the position signal. The processor is further configured to determine a first limit that is functionally dependent upon the command signal, where the first limit delimits an acceptable range of throttle positions from a first unacceptable range of throttle positions. The processor determines that the position of the throttle is not adequately conforming to the command signal when the position of the throttle as indicated by the position signal is in the first unacceptable range of throttle positions.

The present invention further relates to, in a vehicle, a method of determining when a position of a throttle is not adequately conforming to a command signal provided by a control module. The method includes receiving the command signal at a processor, and receiving a position signal indicative of the position of the throttle at the processor. The method additionally includes determining at the processor a first limit that is functionally dependent upon the command signal, where the first limit delimits an acceptable range of throttle positions from a first unacceptable range of throttle positions. The method further includes determining that the position of the throttle is not adequately conforming to the command signal when the position of the throttle as indicated by the position signal is in the first unacceptable range of throttle positions.

The present invention additionally relates to, in a vehicle, a system for determining when a position of a throttle is not adequately conforming to a command signal provided by a control module. The system includes a means for calculating a limit that is functionally dependent upon the command signal, where the limit demarcates an acceptable range of throttle positions from an unacceptable range of throttle positions. The system further includes a means for comparing a position signal indicative of the position of the throttle to the first limit, and a means for determining that the position of the throttle is not adequately conforming to the command signal when the position signal goes beyond the limit. The means for calculating the limit adjusts the limit in a direction tending to expand the acceptable range of throttle positions immediately when the command signal, adjusted by an error band, changes to enter the unacceptable range of throttle positions, and adjusts the limit in a direction tending to reduce the acceptable range of throttle positions when the command signal changes to move away from the unacceptable range of throttle positions.

BRIEF DESCRIPTION OF THE DRAWINGS

FIGS. 3A and 3B are graphs showing exemplary changes in the commanded throttle position (determined by a throttle command signal), exemplary (typical) responses of the actual throttle position to those changes in the commanded throttle position, and preferred high and low limits that demarcate acceptable ranges for the actual throttle position from unacceptable ranges above and below the high and low limits, where the high and low limits are determined according to the present invention based upon the commanded throttle position;

FIG. 6 is a flow chart showing an exemplary computer algorithm that may He employed to generate a low limit that approximates the preferred low limits shown in FIGS. 3A and 3B;

FIG. 8 is a flow chart showing an exemplary computer algorithm that may be employed to generate an alternate high limit other than that generated by the algorithm of FIG. 5;

FIG. 9 is a flow chart showing an exemplary computer algorithm that may be employed to generate an alternate low limit other than that generated by the algorithm of FIG. 6.

DETAILED DESCRIPTION OF THE PREFERRED EMBODIMENT

Figure 1:
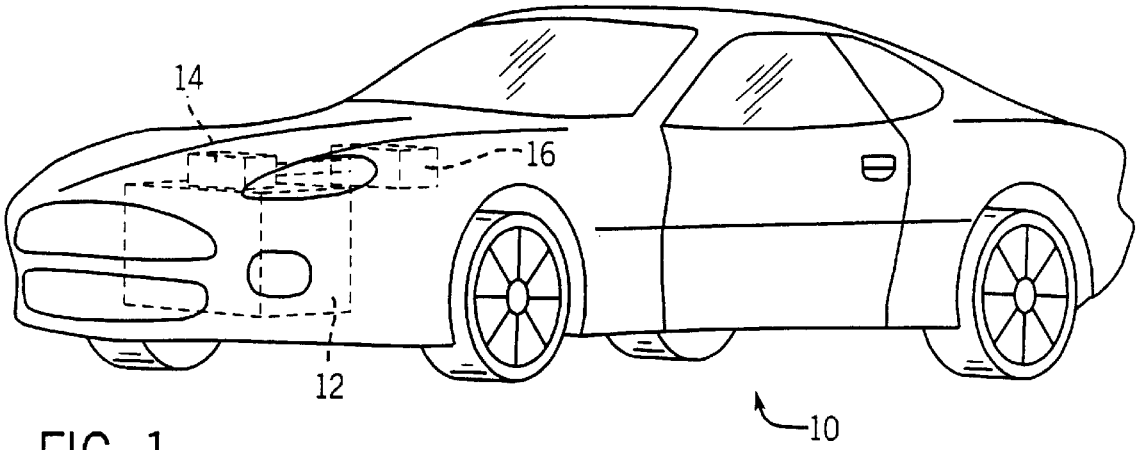
FIG. 1 is an elevation view of an exemplary vehicle having, in phantom, an engine, a throttle assembly, and an electronic throttle control system in which the present invention may be employed.

Referring now to FIG. 1, a vehicle 10 having an engine 12, a throttle assembly 14, and an electronic throttle control system 16 is shown. Vehicle 10 may be any one of a variety of types of vehicles having internal combustion engines or other types of engines that employ throttles, including automobiles, trucks, buses, construction vehicles, agricultural vehicles, and other vehicles.

Figure 2:
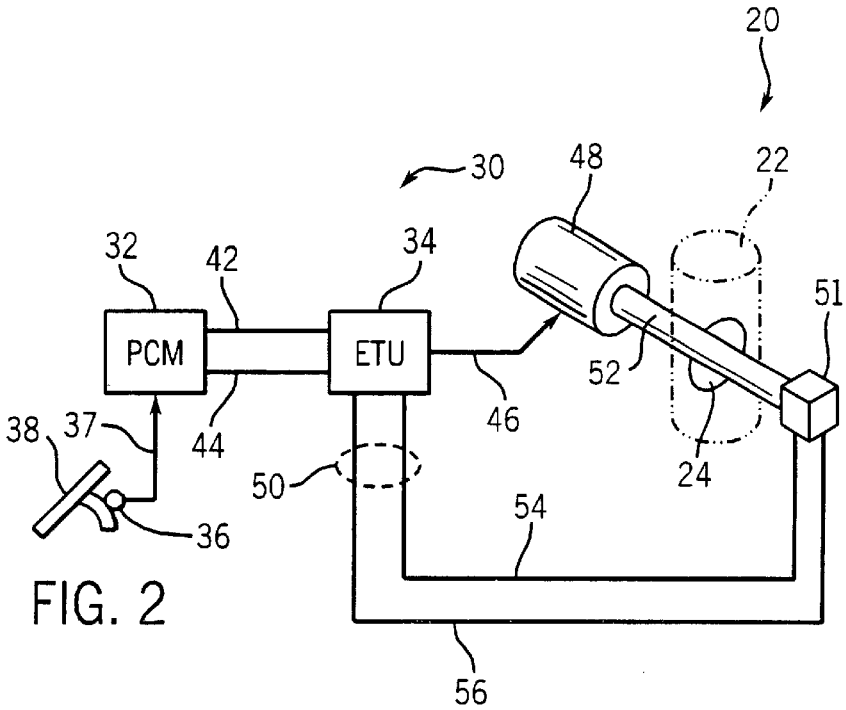
FIG. 2 is a block diagram of an exemplary throttle assembly and electronic throttle control system in which an electronic control algorithm in accordance with the present invention may be employed.

Turning to FIG. 2, elements of an exemplary throttle assembly 20 and an exemplary electronic throttle control system 30 are shown. Throttle assembly 20 includes a conduit (e.g., a tube, pipe or other channel) 22 through which air or an air-fuel mixture is to flow. Positioned within conduit 22 is a throttle plate (or simply throttle) 24, which is elliptical in shape and rotates within conduit 22 (which is cylindrical). In alternate embodiments, conduit 22 may take on any number of different shapes; in such cases, throttle plate 24 also takes on a corresponding shape such that the throttle plate may, when rotated to a closed position, completely close off (or nearly completely close off) the conduit.

Electronic throttle control system 30 includes a power train control module (PCM) 32 that is coupled to an electronic throttle unit (ETU) 34. PCM 32 receives an operator input signal 37 from a pedal position sensor 36, which indicates the angular deflection of an accelerator pedal 38 as actuated by the vehicle driver. PCM 32 provides a throttle command signal 40 on a first channel 42 and also on a second channel 44 to ETU 34. Throttle command signal 40 is generated based upon operator input signal 37 and indicates a desired throttle position. First and second channels 42, 44 can be provided on separate conductors, so as to reduce the chance of loss of both signals from a conductor break, or can be time or frequency multiplexed on a single conductor. In alternate embodiments, throttle command signal 40 is provided from PCM 32 to ETU 34 via only a single channel. Also, in alternate embodiments, PCM 32 provides throttle command signal 40 based on information other than (or in addition to) operator input signal 37 (e.g., the throttle command signal can be completely generated by a computer in an automatic mode of control). Based upon throttle command signal 40, ETU 34 provides an output signal (typically a voltage signal) 46 to a throttle actuator 48 (for example, an electric motor) providing a rotating shaft 52 attached to throttle plate 24. Output signal 46 is based upon (or even equivalent to) throttle command signal 40, and is provided to cause throttle actuator 48 to rotate throttle plate 24 to the desired throttle position. Also coupled to throttle plate 24 are one or more sensors 51 for generating a throttle position signal 50 indicative of actual throttle position, and providing the throttle position signal to ETU 34 via a first feedback channel 54 and a redundant feedback channel 56. The information in throttle position signal 50 provided via first and redundant feedback channels 54, 56 is used by ETU 34 for closed loop control of throttle plate 24 by adjusting output signal 46. Feedback channels 54, 56 can be provided on separate conductors, so as to reduce the chance of loss of both signals from a conductor break, or can be time or frequency multiplexed on a single conductor.

Each of PCM 32 and ETU 34 preferably is (or includes) a microcontroller or other computer processor having memory. The memory of PCM 32 includes a computer program for generating throttle command signal 40 indicative of the commanded throttle position based upon operator input signal 37. The memory of ETU 34 includes a computer program for monitoring and controlling the operation of throttle plate 24 in response to throttle command signal 40. Specifically, ETU 34 monitors the difference between the actual throttle position as indicated by throttle position signal 50 and the commanded throttle position as indicated by throttle command signal 40. Based upon the difference between the actual throttle position and the commanded throttle position, ETU 34 then adjusts output signal 46 to cause throttle plate 24 to adjust towards the commanded throttle position. In alternate embodiments, PCM 32 and ETU 34 can be combined into a single control unit, which performs the functions of the PCM and ETU. Further, in alternate embodiments, PCM 32 and ETU 34 (or the combined controller) are hard-wired rather than microcontroller-based.

In accordance with the present invention, the computer program within ETU 34 also determines whether the difference between the actual throttle position and the commanded throttle position is so great as to indicate improper throttle operation. The computer program of ETU 34 performs this determination by generating high and low limits that demarcate an acceptable range of actual throttle positions above and below the commanded throttle position from unacceptable ranges above and below the high and low limits, respectively. ETU 34 then determines whether the actual throttle position is respectively above or below the high or low limits and, if so, determines that improper throttle operation (i.e., a fault) has occurred. Although in the preferred embodiment, both high and low limits are determined, alternate embodiments can employ either a high limit or a low limit alone.

Referring to FIGS. 3A and 3B, exemplary, preferred high and low limits demarcating the acceptable range of actual throttle positions are shown in relation to exemplary changes in the commanded throttle position and exemplary behavior of the actual throttle position (in response to the changes in the commanded throttle position). Only step changes in the commanded throttle position are shown, since throttle command signal 40 is typically a sampled signal. The high and low limits of FIGS. 3A and 3B are configured (by ETU 34) to allow for various types of expected differences between the commanded throttle position and the actual throttle position. As discussed in the Background of the Invention, some of the differences can occur due to recurring or intermittent, but typically minor, sources of error (e.g., noise in output signal 46). The magnitude of these differences do not depend particularly upon the changes in the commanded throttle position. Other differences typically occur due to the inability of the throttle actuator 48 (actuating throttle plate 24) to respond immediately to step changes in the commanded throttle position, such that the actual throttle position only gradually responds to changes in the commanded throttle position. These differences are "dynamic", i.e., the magnitude of these differences depends upon the magnitude and frequency (and history) of the changes in the commanded throttle position.

To allow for those differences that do not depend particularly upon the changes in the commanded throttle position, ETU 34 always calculates the high and low limits to include a minimum error band above and below, respectively, the commanded throttle position. Thus, in FIGS. 3A and 3B, both the high and low limits remain a certain distance from the actual throttle position even when the actual throttle position reaches a steady state (i.e., upon the commanded throttle position remaining constant for a period of time and the actual throttle position attaining that commanded throttle position).

Further, to allow for the "dynamic" differences, the high and low limits determined by ETU 34 also depend upon the changes in the commanded throttle position. In FIG. 3A, the commanded throttle position (i.e., as determined from throttle command signal 40) is shown to increase in a step-up manner at a time $t_1$. A typical response of the actual throttle position is also shown. Although the actual throttle position does increase in response to the step-up of the commanded throttle position, the increase of the actual throttle position does not occur in a step-up manner but rather only occurs in a more gradual (and oscillatory) manner after time $t_1$. The exact response of the actual throttle position can depend upon several factors, such as whether there is significant inertia associated with the movement of the throttle.

Because the commanded throttle position increases in a step-up manner, it would be acceptable (and typically desirable) for the actual throttle position to also increase in a step-up manner, if possible. Consequently, the high limit demarcating the acceptable range of actual throttle positions from the unacceptable range of actual throttle positions (above the high limit) steps-up at time $t_1$ in response to the step-up of the commanded throttle position at time $t_1$. However, because the typical response of the actual throttle position to the step-up of the commanded throttle position is not a step-up, but rather is a gradual increase, the low limit demarcating the acceptable range of actual throttle positions from the unacceptable range (below the limit) cannot step up at time $t_1$. Rather, the low limit moves upward only at a later time, and in the preferred embodiment, ramps upward.

Turning to FIG. 3B, a preferred mode of operation in response to a step-down of the commanded throttle position is shown. Similar to the response of the actual throttle position in FIG. 3A to the step-up of the commanded throttle position, the response of the actual throttle position to the step-down of the commanded throttle position in FIG. 3B is a gradual, oscillatory response. Because ideally the actual throttle position would respond immediately to the step-down of the commanded throttle position, the low limit is shown to step-down immediately at time $t_1$. However, as with the low limit shown in FIG. 3A, the high limit does not immediately step-down since the expected behavior of the actual throttle position is a gradual move downward. Thus, the high limit only ramps downward in response to the step-down of the commanded throttle position at a time later than time $t_1$.

As shown in FIGS. 3A and 3B, the manner in which the high and low limits respond to changes of the commanded throttle position depends upon whether the changes in the commanded throttle position would tend to cause the actual throttle position to move beyond its previous limits (or, equivalently, whether the changes in the commanded throttle position are such that the commanded throttle position adjusted by an error band moves beyond the previous limits). If the change in the commanded throttle position (which, as discussed, is always either a step-up or a step-down) would tend to cause the actual throttle position to move beyond an existing high or low limit (plus or minus the constant error band), that limit should be adjusted in a step manner to immediately expand the acceptable range of actual throttle positions. However, if the change in the commanded throttle position would tend to cause the actual throttle position to move away from an existing limit, then that limit should be adjusted in a time-delayed, ramping manner to allow for the expected gradual change of the actual throttle position.

As shown in FIGS. 3A and 3B, the preferred response of a limit when a change in the commanded throttle position would tend to cause the actual throttle position to move away from that limit is a time-delayed ramp response. This time-delayed ramp response is preferred because it is simple to implement (i.e., program) and calculate. Further, a time-delayed ramp response fairly closely reflects the behavior of the actual throttle position where the throttle response is dominated by integral control (for example, in the case of small motors and movements of 2–4 degrees).

Figure 4A:
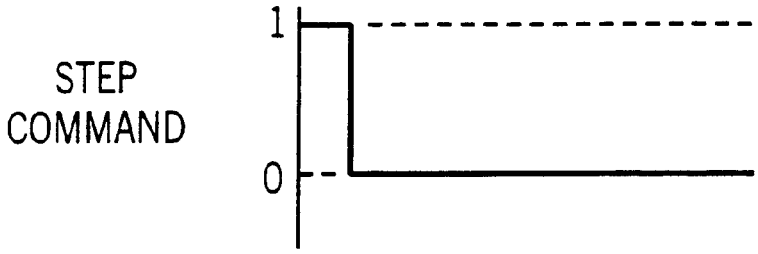
FIGS. 4A, 4B and 4C are graphs showing response patterns based upon which alternate high and/or low limits demarcating acceptable and unacceptable ranges for the actual throttle position can be based.
Figure 4B:
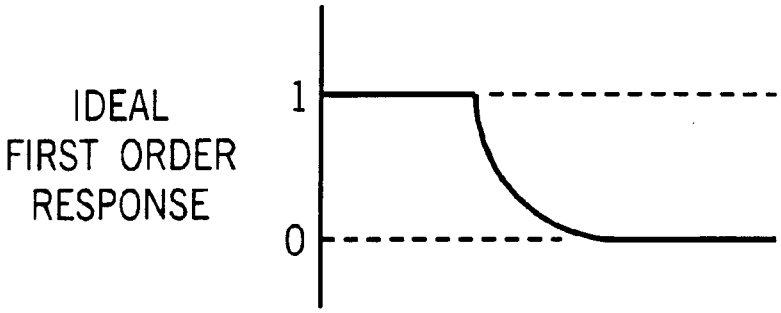
Figure 4C:
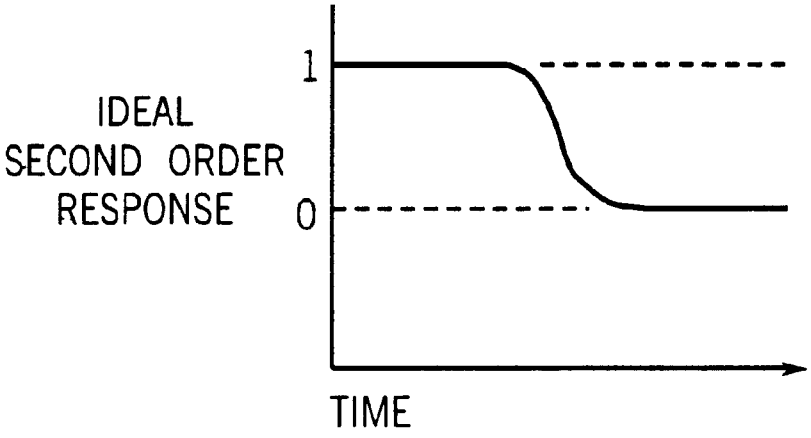

However, as shown in FIGS. 4A through 4C, in alternate embodiments, alternate responses can be employed. For example, the response of the limit to a step change in the commanded throttle position (FIG. 4A) can be a time-delayed first order response (FIG. 4B). As with the time-delayed ramp response, such a time-delayed first order response is relatively easy to implement. Such a response fairly closely reflects the sigmoid response of a throttle (for example, in the case of motors making movements of greater 4 degrees). Further, as shown in FIG. 4C, the limit may be configured to respond in a second-order fashion, which also can (but need not) be time-delayed. Such a response would typically bear a greater similarity to the expected response of the actual throttle position. However, the programming of such a second-order response is relatively more complicated (and in any event still does not perfectly match the expected behavior of the actual throttle position). Other responses (i.e., even more complicated response patterns) can also be employed in further alternate embodiments.

Figure 5:
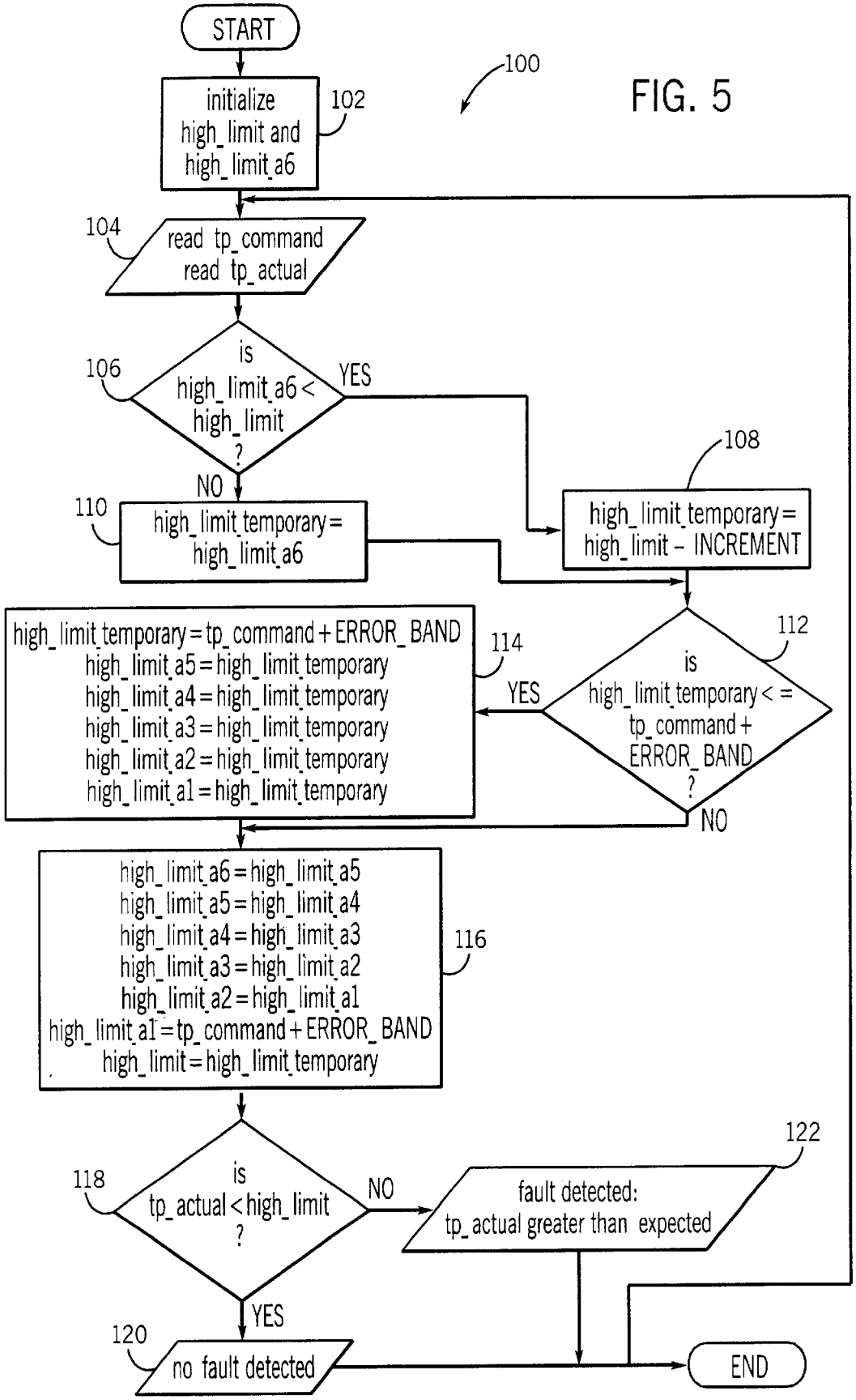
FIG. 5 is a flow chart showing an exemplary computer algorithm that may be employed to generate a high limit that approximates the preferred high limits shown in FIGS. 3A and 3B.

Turning now to FIGS. 5 and 6, flow charts 100, 200 outline computer algorithms that are performable by ETU 34, and are for generating in approximate form the limits described in FIGS. 3A and 3B, respectively. The algorithm of flow chart 100 (FIG. 5) generates a high limit that steps-up if the commanded throttle position steps-up to such an extent as to cause the actual throttle position to exceed the existing high limit (i.e., steps-up to such an extent that the commanded throttle position plus an error band exceeds the existing high limit). Further, the high limit generated according to flow chart 100 approximates a ramp downward, following a time delay, if the commanded throttle position steps-down (in which case the actual throttle position should decrease away from the existing high limit, such that the high limit should be reduced). The algorithm of flow chart 100 only approximates the ramp downward since, as discussed below, the high limit steps-down, in small increments (corresponding to discrete cycles through the algorithm), instead of continuously ramping down.

Upon starting the algorithm of flow chart 100, a current high limit value (high_limit) and a target high limit value (high_limit_a6) are initialized in step 102. (It may also be necessary to initialize five delayed high limit values, discussed below.) Both the current and target high limit values can (but need not) be set equal to the same value in the initialization step. Proceeding to step 104, a commanded throttle position value (tp_command) and an actual throttle position value (tp_actual) are obtained. The commanded throttle position value is provided from PCM 32 in the form of throttle command signal 40, and the actual throttle position value is provided from sensor(s) 51 in the form of throttle position signal 50.

Next, at step 106, the current and target high limit values (respectively, high_limit and high_limit_a6) are compared with one another. If the target high limit value is less than the current high limit value, it is appropriate for the high limit to be ramping down. Consequently, the algorithm proceeds to step 108, which sets a temporary high limit value (high_limit_temporary) equal to the current high limit value minus an increment. (The temporary high limit value represents the same quantity as the current high limit value; the temporary high limit value is used as a proxy for the current high limit value during the critical steps of the algorithm.) Otherwise, the algorithm proceeds to step 110, where the temporary high limit value is set equal to the target high limit value.

The algorithm then proceeds to step 112, in which the temporary high limit value is compared to the sum of the commanded throttle position value and an error band. If the sum of the commanded throttle position value and the error band is greater than or equal to the temporary high limit, the algorithm proceeds to step 114. This particularly occurs when the commanded throttle position value has stepped-up to an extent that would eventually cause the actual throttle position value (plus the error band) to exceed the current high limit value (i.e., high_limit_temporary <tp_command+ERROR_BAND). In this case, the current high limit value should immediately be increased to account for the increase in the commanded throttle position value. Thus, in step 114, the algorithm sets the temporary high limit value, as well as five delayed high limit values (discussed below), equal to the commanded throttle position value (plus the error band). The algorithm then proceeds to step 116, in which the target high limit value and the current high limit value are both also set equal to the commanded throttle position value (plus the error band). Thus, a new (higher) current high limit value is established.

If the sum of the commanded throttle position value and the error band is less than the temporary high limit value, the algorithm skips step 114 and proceeds directly to step 116. This typically occurs when the commanded throttle position has stepped-down, which will cause the actual throttle position value to decrease and move away from the current high limit value (i.e., the existing high limit). A new, reduced target high limit value must be set, toward which the high limit will ramp downward. However, the target high limit value cannot immediately be set to the new, reduced level until a time delay has passed (since the actual throttle position will not respond immediately to the change in the commanded throttle position, a timedelayed ramp response is necessary).

Thus, in step 116, only a first delayed high limit value (high_limit_a1) is set equal to the commanded throttle position value (plus the error band). The target high limit value (high_limit_a6) only later becomes equal to the reduced commanded throttle position value (plus the error band), following five more cycles through step 116 of the algorithm. During each of these respective cycles, the remaining four delayed high limit values (high_limit_a2, high_limit_a3, high_limit_a4, and high_limit_a5) and finally the target high limit value are successively set equal to the commanded throttle position value (plus the error band). Once the target high limit value becomes equal to the new, reduced commanded throttle position value, the target high limit value becomes less than the current high limit value (which, due to the time delay, remains at the existing high level) and the algorithm proceeds through step 108, creating the ramp downward.

During each cycle through the algorithm, the actual throttle position value (tp_actual) is compared with the current high limit value at step 118. If the actual throttle position value is greater than or equal to the current high limit value, the actual throttle position is outside of the acceptable range of actual throttle positions and so the algorithm proceeds to step 122, where a fault is detected. If the actual throttle position value is less than the current high limit value, the actual throttle position is within the acceptable range of actual throttle positions and so no fault is detected (step 120). Upon completion of steps 120 or 122, the algorithm then returns to step 104 and obtains new commanded throttle position and actual throttle position values (unless program operation is ended).

The speed at which the algorithm of flow chart 100 proceeds to ramp downward will depend upon the size of the increments in step 108, as well as depend upon the time required to cycle through the algorithm. The length of the delay between the time the commanded throttle position value steps downward and the time at which the ramping action of the algorithm begins depends upon the number of delayed high limit values (i.e., an algorithm having ten delayed high limit values as opposed to only five delayed high limit values as shown here will have a longer delay), and also depends upon the time required to cycle through the program. In different embodiments, each of these attributes of the algorithm can be varied considerably. In addition, the error band may be varied. In one embodiment, an algorithm with a cycle having a period of 2 milliseconds, a time delay of 5 cycles, an increment of 1 degree per cycle, and an error band of 5 degrees was used.

Turning to FIG. 6, flow chart 200 sets forth an algorithm that directly parallels the algorithm of flow chart 100, except insofar as the algorithm concerns the generation of a low limit as opposed to a high limit. The program generates a low limit which steps-down if the commanded throttle position value falls to a level that would cause the actual throttle position value to fall below the existing low limit (i.e., steps-down to such an extent that the commanded throttle position minus an error band falls below the existing low limit). Also, the low limit generated by the algorithm ramps upward (in small increments), following a time delay, if the commanded throttle position value (minus an error band) increases above the previous low limit. The algorithm of flow chart 200 includes steps 202 through 222, which directly (respectively) correspond to steps 102 through 122 of flow chart 100.

Figure 7:
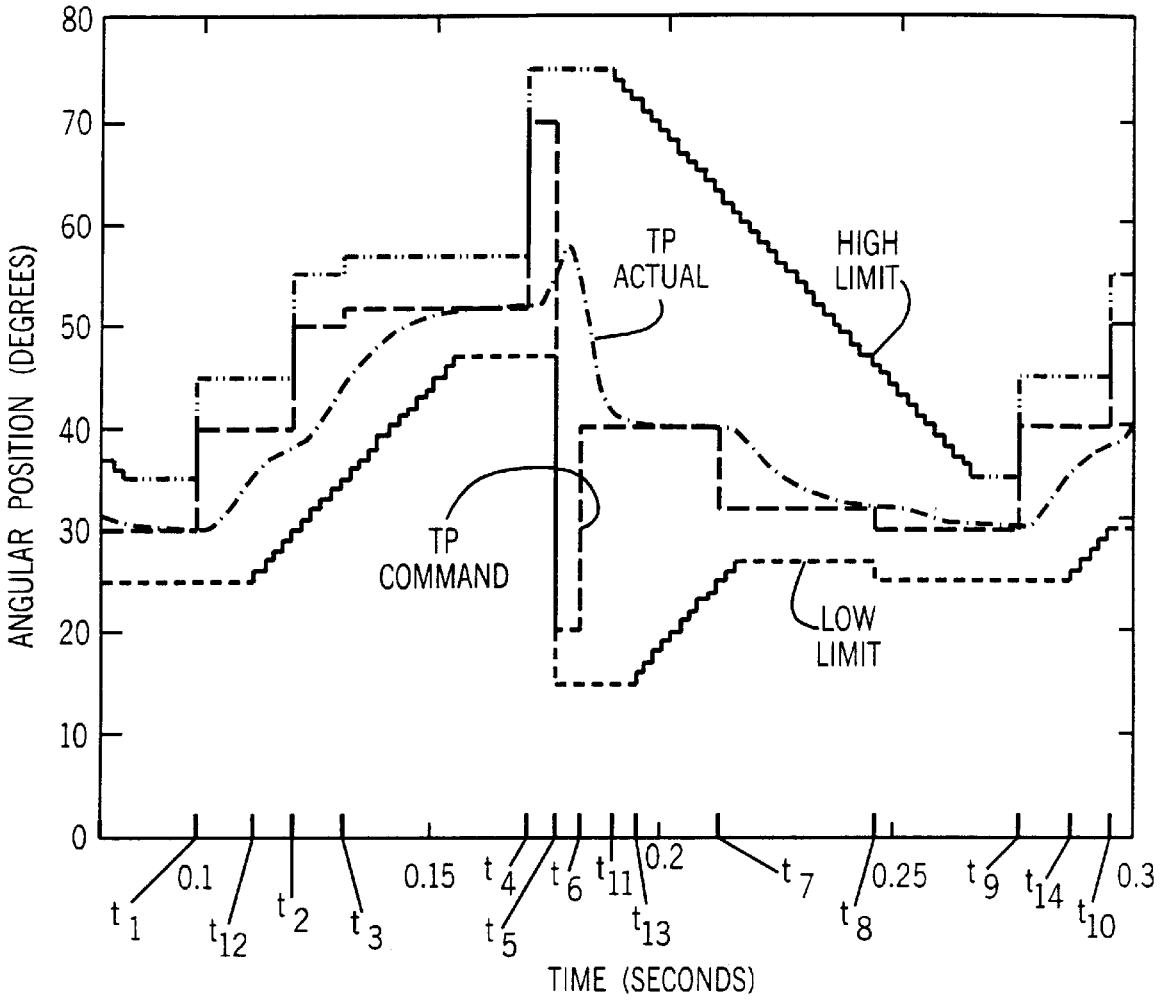
FIG. 7 is a graph showing exemplary changes in the commanded throttle position (determined by a throttle command signal), exemplary (typical) responses of the actual throttle position to those changes in the commanded throttle position, and high and low limits generated using the computer algorithms of FIGS. 5 and 6.

Turning to FIG. 7, an exemplary graph of the commanded throttle position and actual throttle position versus time is shown. Included on the graph are high and low limits generated by way of the algorithms of flow charts 100, 200. The commanded throttle position makes ten separate step changes up or down during the time period shown. At times $t_1$, $t_2$, $t_3$, $t_4$, $t_6$, $t_9$, and $t_{10}$, the commanded throttle position steps-up. At times $t_1$, $t_2$, $t_3$, $t_4$, $t_9$, and $t_{10}$, the high limit also steps-up in response to the steps-up of the commanded throttle position. However, at time $t_6$, the high limit does not step-up despite the step-up of the commanded throttle position since the step-up of the commanded throttle position is not sufficient to cause the actual throttle position to move above the existing high limit at time $t_6$ (i.e., the commanded throttle position plus an error band does not exceed the existing high limit). The error band can be seen as the difference between the commanded throttle position and the high limit between, for example, times $t_1$ and $t_2$.

At times $t_5$, $t_7$, and $t_8$, the commanded throttle position steps-down, causing the actual throttle position to move away from the high limit. As shown, the high limit begins to ramp downward towards the new commanded throttle position (plus the error band) only after the passage of a time delay equaling the difference between time $t_{11}$ and $t_5$. The importance of the time delay in postponing any reduction in the high limit is evident from an examination of the actual throttle position, which continues to move upward after time $t_5$ even though the commanded throttle position has just made a significant step-down.

Also shown in FIG. 7 is a low limit. The low limit steps-down at times $t_5$ and $t_8$, and also ramps upward beginning at times $t_{12}$, $t_{13}$, and $t_{14}$. As with respect to the ramping down of the high limit, the low limit only begins to ramp upward after the occurrence of a certain time delay after the precipitating step-up by the commanded throttle position. Although the time delay (equaling the difference between times $t_{12}$ and $t_1$, times $t_{13}$ and $t_6$, and times $t_{14}$ and $t_9$) all are the same and are equal to the time delay exhibited by the high limit, the time delays of the low and high limits need not be identical, nor does the time delay for each particular limit need to be constant throughout the operation of the system.

Referring to FIGS. 8 and 9, alternate embodiments of flow charts 100 and 200 are shown, respectively. Flow chart 300 includes steps 302 through 322 which correspond to steps 102 through 122 of flow chart 100. Flow chart 300 is for an algorithm generating a high limit, where the high limit decreases in an approximately first-order (exponential) response manner in response to a step-down of the commanded throttle position. The first-order response is generated at step 308 (which corresponds to step 108 of flow chart 100). The formula shown in step 308 may be used to calculate the exponential response, or another similar formula may be used.

With respect to FIG. 9, flow chart 400 shows an algorithm for generating a low limit that is identical to that generated by the algorithm of flow chart 200, except that the low limit increases in an approximately first-order (exponential) manner in response to increases in the commanded throttle position (instead of ramping upward). Although flow charts 300, 400 each have the same number of delay values as are shown in flow charts 100, 200, flow charts 300, 400 may also utilize a smaller or larger number of delays to increase or decrease the time delay between a change in commanded throttle position and the beginning of the exponential response of a limit to that change in the commanded throttle position.

Figure 10:
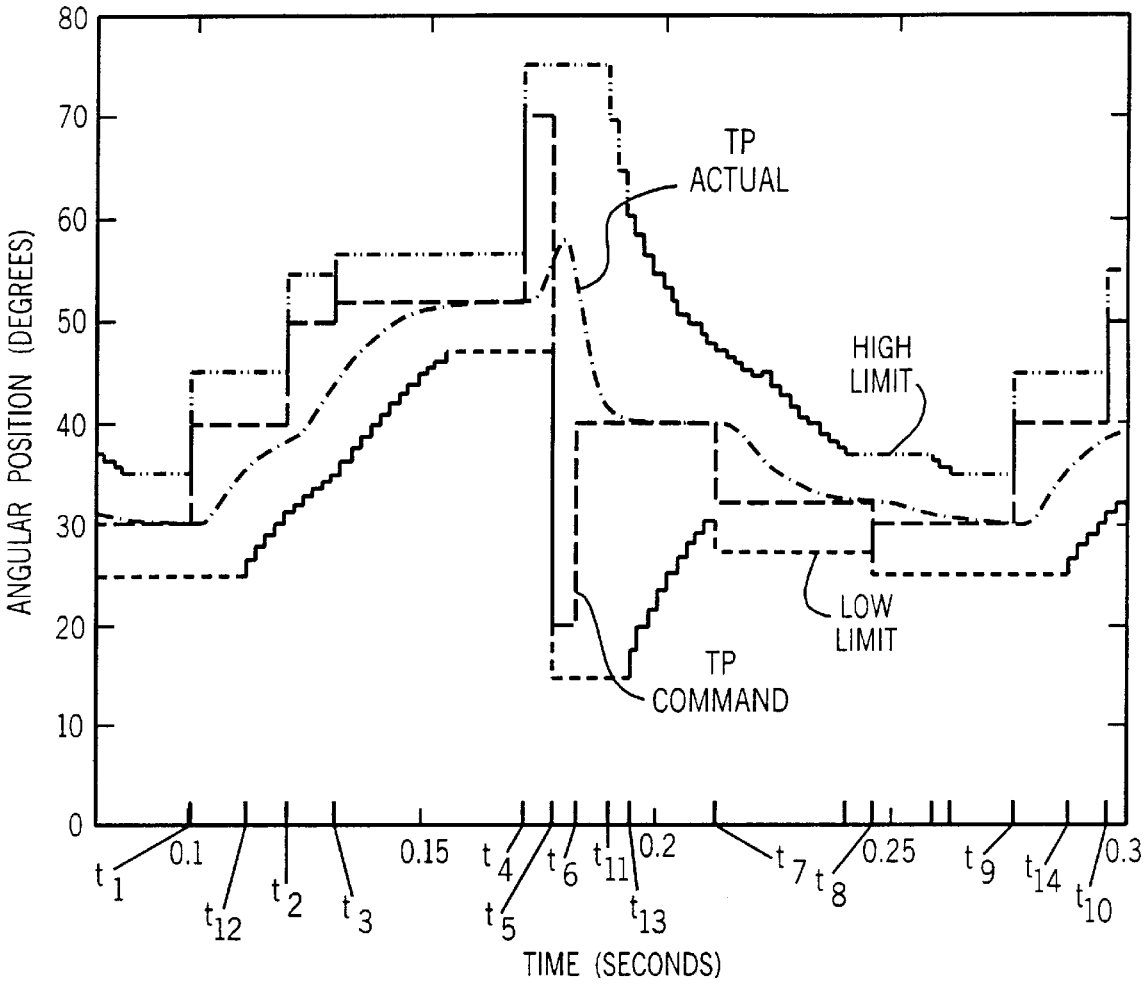
FIG. 10 is a graph showing exemplary changes in the commanded throttle position (determined by a throttle command signal), exemplary (typical) responses of the actual throttle position to those changes in the commanded throttle position, and high and low limits generated using the computer algorithms of FIGS. 8 and 9.

Finally, turning to FIG. 10, the graph of the exemplary commanded throttle position and actual throttle position shown in FIG. 7 is again shown. FIG. 10 also shows high and low limits generated using the algorithms of flow charts 300, 400. The high limit decreases in an exponential manner after time $t_{11}$ rather than ramping downward. Likewise, the low limit increases in an exponential manner following times $t_{12}$, $t_{13}$, and $t_{14}$. As shown, the alpha used to generate the exponential responses was 0.1 fraction per loop.

In alternate embodiments, different algorithms can be employed in place of the algorithms of flow charts 300, 400. For example, the alpha may be adjusted depending upon the application to increase or decrease the rapidity with which the limits respond to the commanded throttle position. Also, as with respect to the algorithms of flow charts 100 and 200, the algorithms of flow charts 300 and 400 only approximate the first-order responses described above (see FIG. 4B). The responses generated by these algorithms are made up of a series of small step changes, the smoothness of which can be increased by decreasing the size of the steps and increasing the speed at which the algorithms are performed. Alternate embodiments can employ different algorithms with more continuous output.

It will occur to those that practice the art that many modifications may be made without departing from the spirit and scope of the invention. For example, other algorithms may be used to generate the limits of the acceptable range of actual throttle position that are more complicated and more closely reflect expected throttle behavior. Also, multiple algorithms may be used at different times in the system as throttle operation changes over time or in response to different operational conditions of the vehicle. In order to apprise the public of the various embodiments that may fall within the scope of the invention, the following claims are made:

What is claimed is:

1. A throttle error detection system for determining when a position of a throttle is not adequately conforming to a command signal provided by a control module such that a fault indication should be provided, the system comprising:

a throttle assembly including the throttle and configured to generate a position signal indicative of the position of the throttle; and a processor coupled to the throttle assembly and configured to receive the command signal and the position signal, wherein the processor is further configured to determine a first limit that is functionally dependent upon the command signal, the first limit delimiting an acceptable range of throttle positions from a first unacceptable range of throttle positions, and wherein the processor determines that the position of the throttle is not adequately conforming to the command signal when the position of the throttle as indicated by the position signal is in the first unacceptable range of throttle positions.

2. The system of claim 1, wherein the processor adjusts the first limit in a direction tending to expand the acceptable range of throttle positions immediately when the command signal adjusted by an error band changes to enter the first unacceptable range of throttle positions, and wherein the processor adjusts the first limit in a direction tending to reduce the acceptable range of throttle positions when the command signal changes to move away from the first unacceptable range of throttle positions.

3. The system of claim 2, wherein the processor is further configured to determine a second limit that is functionally dependent upon the command signal, the second limit delimiting the acceptable range of throttle positions from a second unacceptable range of throttle positions, and wherein the processor also determines that the position of the throttle is not adequately conforming to the command signal when the position of the throttle as indicated by the position signal is in the second unacceptable range of throttle positions.

4. The system of claim 3, wherein the processor adjusts the second limit in a direction tending to expand the acceptable range of throttle positions immediately when the command signal adjusted by the error band changes to enter the second unacceptable range of throttle positions, and wherein the processor adjusts the second limit in a direction tending to reduce the acceptable range of throttle positions when the command signal changes to move away from the second unacceptable range of throttle positions.

5. The system of claim 4, wherein the first limit is a high limit and the second limit is a low limit.

6. The system of claim 2 wherein, when the command signal changes in a step manner such that the command signal adjusted by the error band enters the first unacceptable range of throttle positions, the processor determines the first limit to include a step change in the same direction.

7. The system of claim 2 wherein, when the command signal changes in a step manner away from the first unacceptable range of throttle positions at a first time, the processor calculates the first limit as ramping in the direction of the step.

8. The system of claim 7, wherein the ramping only begins at a second time that is delayed with respect to the first time.

9. The system of claim 2 wherein, when the command signal changes in a step manner away from the first unacceptable range of throttle positions at a first time, the processor calculates the first limit as changing in the direction of the step, in a first order response manner.

10. The system of claim 9, wherein the first order response only begins at a second time that is delayed with respect to the first time.

11. The system of claim 2 wherein, when the command signal changes in a step manner away from the first unacceptable range of throttle positions at a first time, the processor calculates the first limit as changing in the direction of the step, in a second order response manner.

12. The system of claim 11, wherein the second order response only begins at a second time that is delayed with respect to the first time.

13. The system of claim 1, wherein the processor includes a microprocessor and software allowing for the determining of the first limit.

14. In a vehicle, a method of determining when a position of a throttle is not adequately conforming to a command signal provided by a control module, the method comprising:

receiving the command signal at a processor;

receiving a position signal indicative of the position of the throttle at the processor;

determining at the processor a first limit that is functionally dependent upon the command signal, the first limit delimiting an acceptable range of throttle positions from a first unacceptable range of throttle positions; and determining that the position of the throttle is not adequately conforming to the command signal when the position of the throttle as indicated by the position signal is in the first unacceptable range of throttle positions.

15. The method of claim 14, further comprising:

adjusting the first limit in a direction tending to expand the acceptable range of throttle positions immediately when the command signal, adjusted by an error band, changes to enter the first unacceptable range of throttle positions; and adjusting the first limit in a direction tending to reduce the acceptable range of throttle positions when the command signal changes to move away from the first unacceptable range of throttle positions.

16. The method of claim 15, further comprising:

determining at the processor a second limit that is functionally dependent upon the command signal, the second limit delimiting the acceptable range of throttle positions from a second unacceptable range of throttle positions; and determining that the position of the throttle is not adequately conforming to the command signal when the position of the throttle as indicated by the position signal is in the second unacceptable range of throttle positions.

17. The method of claim 16, further comprising:

adjusting the second limit in a direction tending to expand the acceptable range of throttle positions immediately when the command signal, adjusted by an error band, changes to enter the second unacceptable range of throttle positions; and adjusting the second limit in a direction tending to reduce the acceptable range of throttle positions when the command signal changes to move away from the second unacceptable range of throttle positions.

18. The method of claim 15, further comprising, when the command signal changes in a step manner away from the first unacceptable range of throttle positions at a first time, calculating the first limit as ramping in the direction of the step, wherein the ramping only begins at a second time that is delayed with respect to the first time.

19. The method of claim 16, further comprising, when the command signal changes in a step manner away from the first unacceptable range of throttle positions at a first time, calculating the first limit as changing in the direction of the step in a first order response manner, wherein the first order response only begins at a second time that is delayed with respect to the first time.

20. In a vehicle, a system for determining when a position of a throttle is not adequately conforming to a command signal provided by a control module, the system comprising:

means for calculating a limit that is functionally dependent upon the command signal, the limit demarcating an acceptable range of throttle positions from an unacceptable range of throttle positions;

means for comparing a position signal indicative of the position of the throttle to the first limit; and means for determining that the position of the throttle is not adequately conforming to the command signal when the position signal goes beyond the limit, wherein the means for calculating the limit adjusts the limit in a direction tending to expand the acceptable range of throttle positions immediately when the command signal, adjusted by an error band, changes to enter the unacceptable range of throttle positions, and adjusts the limit in a direction tending to reduce the acceptable range of throttle positions when the command signal changes to move away from the unacceptable range of throttle positions.

* * * * *

UNITED STATES PATENT AND TRADEMARK OFFICE

CERTIFICATE OF CORRECTION

PATENT NO. : 6,499,462 B1
DATED : December 31, 2002
INVENTOR(S) : Ross Dykstra Pursifull It is certified that error appears in the above-identified patent and that said Letters Patent is hereby corrected as shown below:

Column 3,
Line 59, “may He employed” should be -- may be employed --.

Column 8,
Line 55, “timedelayed” should be -- time delayed --.

Signed and Sealed this

Fifteenth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,499,462 B1
DATED : December 31, 2002
INVENTOR(S) : Pursifull

It is certified that error appears in the above-identified patent and that said Letters Patent is hereby corrected as shown below:

Column 11, line 24 and Column 13, line 2,
Please replace claims with the claims attached.

Correct Claims

1. A throttle error detection system for determining when a position of a throttle is not adequately conforming to a command signal provided by a control module such that a fault indication should be provided, the system comprising:

a throttle assembly including the throttle and configured to generate a position signal indicative of the position of the throttle; and a processor coupled to the throttle assembly and configured to receive the command signal and the position signal, wherein the processor is further configured to determine a first limit that is functionally dependent upon the command signal, the first limit delimiting an acceptable range of throttle positions from a first unacceptable range of throttle positions, wherein the processor determines that the position of the throttle is not adequately conforming to the command signal when the position of the throttle as indicated by the position signal is in the first unacceptable range of throttle positions, wherein the processor adjusts the first limit in a direction tending to expand the acceptable range of throttle positions immediately when the command signal adjusted by an error band changes to enter the first unacceptable range of throttle positions, and wherein the processor adjusts the first limit in a direction tending to reduce the acceptable range of throttle positions when the command signal changes to move away from the first unacceptable range of throttle positions.

2. The system of claim 1, wherein the processor is further configured to determine a second limit that is functionally dependent upon the command signal, the second limit delimiting the acceptable range of throttle positions from a second unacceptable range of throttle positions, and wherein the processor also determines that the position of the throttle is not adequately conforming to the command signal when the position of the throttle as indicated by the position signal is in the second unacceptable range of throttle positions.

CERTIFICATE OF CORRECTION

PATENT NO. : 6,499,462 B1
DATED : December 31, 2002
INVENTOR(S) : Pursifull

It is certified that error appears in the above-identified patent and that said Letters Patent is hereby corrected as shown below:

3. The system of claim 2, wherein the processor adjusts the second limit in a direction tending to expand the acceptable range of throttle positions immediately when the command signal adjusted by the error band changes to enter the second unacceptable range of throttle positions, and wherein the processor adjusts the second limit in a direction tending to reduce the acceptable range of throttle positions when the command signal changes to move away from the second unacceptable range of throttle positions.

4. The system of claim 3, wherein the first limit is a high limit and the second limit is a low limit, and wherein at least at a first time the first limit is adjusted in response to a change in the command signal but the second limit remains the same.

5. The system of claim 1 wherein, when the command signal changes in a step manner such that the command signal adjusted by the error band enters the first unacceptable range of throttle positions, the processor determines the first limit to include a step change in the same direction.

6. The system of claim 1 wherein, when the command signal changes in a step manner away from the first unacceptable range of throttle positions at a first time, the processor calculates the first limit as ramping in the direction of the step.

7. The system of claim 6, wherein the ramping only begins at a second time that is delayed with respect to the first time.

It is certified that error appears in the above-identified patent and that said Letters Patent is hereby corrected as shown below:

8. The system of claim 1 wherein, when the command signal changes in a step manner away from the first unacceptable range of throttle positions at a first time, the processor calculates the first limit as changing in the direction of the step, in a first order response manner.

9. The system of claim 8, wherein the first order response only begins at a second time that is delayed with respect to the first time.

10. The system of claim 1 wherein, when the command signal changes in a step manner away from the first unacceptable range of throttle positions at a first time, the processor calculates the first limit as changing in the direction of the step, in a second order response manner.

11. The system of claim 10, wherein the second order response only begins at a second time that is delayed with respect to the first time.

12. The system of claim 1, wherein the processor includes a microprocessor and software allowing for the determining of the first limit.

13. In a vehicle, a method of determining when a position of a throttle is not adequately conforming to a command signal provided by a control module, the method comprising:

receiving the command signal at a processor;

receiving a position signal indicative of the position of the throttle at the processor;

determining at the processor a first limit that is functionally dependent upon the command signal, the first limit delimiting an acceptable range of throttle positions from a first unacceptable range of throttle positions;

determining that the position of the throttle is not adequately conforming to the command signal when the position of the throttle as indicated by the position signal is in the first unacceptable range of throttle positions;

adjusting the first limit in a direction tending to expand the acceptable range of throttle positions immediately when the command signal, adjusted by an error band, changes to enter the first unacceptable range of throttle positions; and It is certified that error appears in the above-identified patent and that said Letters Patent is hereby corrected as shown below:

adjusting the first limit in a direction tending to reduce the acceptable range of throttle positions when the command signal changes to move away from the first unacceptable range of throttle positions.

14. The method of claim 13, further comprising:

determining at the processor a second limit that is functionally dependent upon the command signal, the second limit delimiting the acceptable range of throttle positions from a second unacceptable range of throttle positions; and determining that the position of the throttle is not adequately conforming to the command signal when the position of the throttle as indicated by the position signal is in the second unacceptable range of throttle positions.

15. The method of claim 14, further comprising:

adjusting the second limit in a direction tending to expand the acceptable range of throttle positions immediately when the command signal, adjusted by an error band, changes to enter the second unacceptable range of throttle positions; and adjusting the second limit in a direction tending to reduce the acceptable range of throttle positions when the command signal changes to move away from the second unacceptable range of throttle positions.

16. The method of claim 13, further comprising, when the command signal changes in a step manner away from the first unacceptable range of throttle positions at a first time, calculating the first limit as ramping in the direction of the step, wherein the ramping only begins at a second time that is delayed with respect to the first time.

17. The method of claim 14, further comprising, when the command signal changes in a step manner away from the first unacceptable range of throttle positions at a first time, calculating the first limit as changing in the direction of the step in a first order response manner, wherein the first order response only begins at a second time that is delayed with respect to the first time.

18. In a vehicle, a system for determining when a position of a throttle is not adequately conforming to a command signal provided by a control module, the system comprising:

means for calculating a limit that is functionally dependent upon the command signal, the limit demarcating an acceptable range of throttle positions from an unacceptable range of throttle positions;

means for comparing a position signal indicative of the position of the throttle to the first limit; and means for determining that the position of the throttle is not adequately conforming to the command signal when the position signal goes beyond the limit, wherein the means for calculating the limit adjusts the limit in a direction tending to expand the acceptable range of throttle positions immediately

UNITED STATES PATENT AND TRADEMARK OFFICE

CERTIFICATE OF CORRECTION

PATENT NO. : 6,499,462 B1
DATED : December 31, 2002
INVENTOR(S) : Pursifull

It is certified that error appears in the above-identified patent and that said Letters Patent is hereby corrected as shown below:

when the command signal, adjusted by an error band, changes to enter the unacceptable range of throttle positions, and adjusts the limit in a direction tending to reduce the acceptable range of throttle positions when the command signal changes to move away from the unacceptable range of throttle positions.

Signed and Sealed this

Sixteenth Day of December, 2003

JAMES E. ROGAN
*Director of the United States Patent and Trademark Office*